United States Patent [19]

Ferrari et al.

[11] Patent Number: 4,720,105

[45] Date of Patent: Jan. 19, 1988

[54] WEIGHT AND BALANCE ADJUSTING ASSEMBLY FOR RACQUETS

[75] Inventors: Harry Ferrari; Raymond P. Harrington; Harry W. Ingram, all of Pittsburgh, Pa.

[73] Assignee: Ferrari Importing Company, Inc., Royal Oak, Mich.

[21] Appl. No.: 771,782

[22] Filed: Sep. 3, 1985

[51] Int. Cl.[4] ..... A63B 49/04

[52] U.S. Cl. ..... 273/73 C; 273/73 J; 273/73 G

[58] Field of Search ..... 273/73 R, 73 C, 73 G, 273/73 J, 75, 171, 167 F, 73 D, 29 A; 301/5 B; 16/DIG. 8; 206/460

[56] References Cited

U.S. PATENT DOCUMENTS

| | | | |
|---|---|---|---|
| 2,257,575 | 9/1941 | Reach | 273/171 |
| 3,273,941 | 9/1960 | Skidmore | 301/5 B |
| 3,625,512 | 12/1971 | Latham | 273/73 C |
| 3,642,283 | 2/1972 | Wilken | 273/73 G |
| 3,749,408 | 7/1973 | Mills | 273/171 |
| 3,913,911 | 10/1975 | Peterson | 273/73 C |
| 4,153,249 | 5/1979 | Plagenhoef | 273/73 C |
| 4,192,505 | 3/1980 | Tabickman et al. | 273/73 C |
| 4,200,285 | 4/1980 | Petitti, Jr. | 273/73 R X |
| 4,355,803 | 10/1982 | Rana | 273/73 J |

FOREIGN PATENT DOCUMENTS

| | | | |
|---|---|---|---|
| 848826 | 8/1970 | Canada | 273/73 C |
| 2724652 | 12/1978 | Fed. Rep. of Germany | 273/73 R |
| 2751171 | 5/1979 | Fed. Rep. of Germany | 273/73 R |
| 3342012 | 5/1985 | Fed. Rep. of Germany | 273/73 J |
| 1047880 | 11/1966 | United Kingdom | 301/5 B |

OTHER PUBLICATIONS

"Pro's Racquets"; Tennis Magazine; Dec. 1980, p. 82.
Lead Tape; Unique Sports Products, Inc.
"Centrifugal Lock Balancing Weights"; Advertisement from American Racing Equipment; 11-1963; 7 pages.

*Primary Examiner*—Matthew L. Schneider
*Attorney, Agent, or Firm*—Hymen Diamond

[57] ABSTRACT

Weight-and-balance adjusting assemblies for use with a racquet for racquet sports. The adjusting assemblies in each case includes a weight having an adhesive formed of an acrylic foam, with very high-bonding properties, secured to its base surface. The unbonded face of the adhesive is secured when an adjusting assembly is in use, secured to a selected part of the racquet. The weight is composed of lead which has a low melting point and is readily moldable to mate with the surface of the part of the racquet to which it is secured or is to be secured. Because of the bonding to the racquet by the adhesive, an adjusting assembly and its weight form an integral part of the racquet. The package includes a card to which a plurality of adjusting assemblies are removably secured. The card carries adjusting assemblies with weights of different magnitudes for the same parts of a racquet and adjusting assemblies for different parts of a racquet. The racquet according to this invention may be a conventional racquet having integral therewith weight-and-balance-adjusting assemblies in accordance with this invention.

3 Claims, 12 Drawing Figures

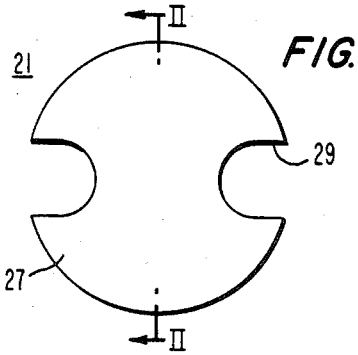
FIG. 1
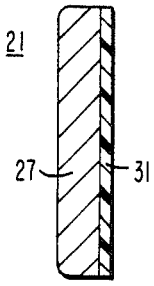
FIG. 2
FIG. 3
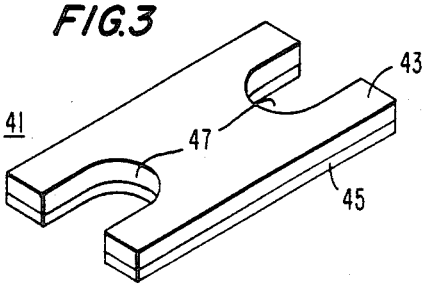
FIG. 4
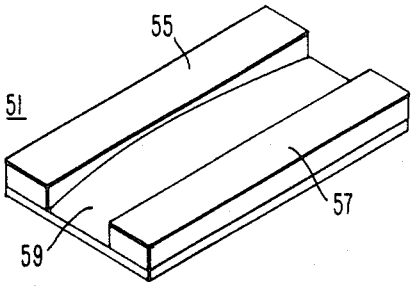
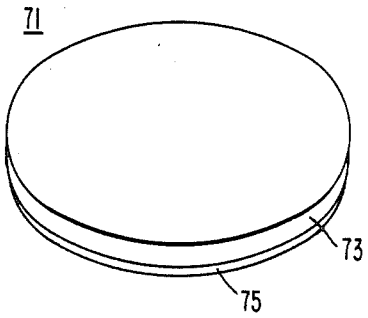
FIG. 5

$W_o$
$W_t$
$W_n$
$W_s$
95
25
23
$BP_o$
$CG_s$
$d_n$

XI
XI
27
33
95
27
71
25
23

27a
21a
31a
90
27b
21b
31b
83
85
89
87
89

81
83
71
27
IX
IX

WEIGHT AND BALANCE ADJUSTING ASSEMBLY FOR RACQUETS

BACKGROUND OF THE INVENTION

This invention relates to racquets for gaming sports such as tennis, squash racquets, racquet ball and badminton. As used in this application, the word racquet comprehends racquets of all types. A racquet has a frame, throat and handle made up as an integral unit of various materials such as wood, graphite fibers, fiberglass, aluminum, steel, boron, titanium, kevlar, polypropylene fibers, polyethylene fibers or combinations of these materials. The frame is strung with string which may be natural gut or synthetic string sometimes referred to as "synthetic gut". The center of gravity of a racquet is at a point along the axis extending between the head and handle of the racquet. This invention relates to the adjustment of the weight and balance of racquets. Particularly, this invention concerns the adjustment of the dynamic balance of a racquet so that it has the desired moment of inertia when it is swept at a ball or shuttlecock in badminton.

Racquets are manufactured with a specified weight within tolerance limits and also with specified center of gravity within tolerance limits. The tolerances are relatively wide so that, as far as the user is concerned, matching of nominally similar racquets with respect to weight and balance is a trial and error process. Users must play test a number of racquets to arrive at the feel of weight and balance and moment of inertia that each prefer.

The playing characteristics of a strung frame of a racquet are dependent on the overall weight, and placement of the weight concentrations along the racquet axes. Personal preferences cover the extremes of the overall weight and weight variations which exist. Most players who develop ball shots that send the ball on long trajectories prefer the balance to be towards the racquet face side; of the midpoint and prefer a heavier overall weight, 350–400 grams. The expression "towards the raquet face side" means away from the handle. Those players who hit the ball on short, high velocity trajectories prefer balance points to the handle side of the midpoint and lighter overall weights, 325–350 grams. Some advanced players prefer to add weight to specific sides of the racquet face to increase the rotational momentum of the racquet through the swing.

The voluminous prior art, spanning between 35 and 45 years, which exists on the adjustment of the weight and balance of racquets (See, for example, Raina U.S. Pat. No. 4,355,803, Col. 1, ln. 30 to Col. 2, ln. 56), demonstrates that this adjustment has been a long-standing problem. This problem has not been satisfactorily solved. In accordance with the current teachings of the prior art there are provided devices for reweighting, rebalancing or increasing the moment of inertia of a racquet which are bulky. In addition, the mounting of these devices on a racquet raises complications. In one case weights are mounted on brackets which are tied to the racquet by straps or strings. The assembly including the bracket, weight and straps would tend to vibrate when a ball is struck causing discomfort and having a tendency to interrupt the concentration of the user. In some cases the weights are installed during manufacture of the racquet. Where such weights are positionally adjustable, such as the members between head and grip disclosed in U.S. Pat. Nos. 2,546,140, 3,912,268, 4,027,881, 4,179,221, the weights would tend to vibrate under the impact of a ball. Where the weights are not positionally adjustable, they can only rarely serve a useful purpose.

It is an object of this invention to overcome the disadvantages and drawbacks of the prior art and to provide weight-and-balance adjusting means or a weight-and-balance adjusting assembly for a racquet which shall be readily integrated into the racquet without requiring brackets or bands and which shall not, when the racquet is in use, cause the racquet to vibrate on impact of a ball. It is also an object of this invention to provide weight-and-balance adjusting means for a racquet which shall afford the user extensive flexibility in readily adJusting the weight and balance.

SUMMARY OF THE INVENTION

In accordance with this invention, weight-and-balancing assemblies are provided which includes a weight to whose surface is secured a very high-bond, double-faced adhesive typically composed of acrylic foam. In use the unbonded face of the adhesive; i.e., the face which is not secured to the weight, is secured to the frame, throat and/or handle of the racquet becoming an integral part of the racquet. The adhesive has a cushioning effect when the racquet strikes a ball so that there is no tendency for the impact of the ball to cause the racquet to vibrate. The weights are relatively small and shaped to accommodate the different areas of the racquet to which each weight is secured. Predominantly each weight may be described as a thin cylinder giving the "cylinder" its general meaning; namely, a surface formed by moving a line perpendicular to a plane around a plane curve in the plane. The shape of the bases of the cylindrical weight may be circular, rectangular, H-shaped, etc. The thickness of cylinders having bases of the same shape may vary so that different weights may be available Typically, the adhesive may be 3Ms' Scotch "VHB" Joining Systems—Model Y-4930 or Model Y-4950. The adhesive is procured in sheets with release liners, typically of paper, on the opposite surfaces The adhesive for each adjustment assembly is stamped out of the sheet. Typically the adhesive also is a thin cylinder with its base the same shape as the weight to which it is to be adhered. The release liner is removed from one face of the adhesive and this face is adhered to one base of the selected weight to form the weight-and-balance adjustment assembly.

The adjustment assemblies may be provided as separate units. In this case, in use, the release liner may be peeled from the unbonded face of the adhesive and the assembly may be secured to the selected part of a racquet by the exposed adhesive. The weight is composed of a low-melting-point metal, such as lead, and since it is thin, the assembly, if it is adhered to a curved part of a racquet, may be molded to mate with the part selected. Preparatory to the securing of an adjustment assembly to a racquet, the selected part is cleaned with a solution of isopropyl alcohol and acetone to remove solid release agents (silicones) from the surface.

If the user is dissatisfied with the weight and balance of the racquet as adjusted when, for example, he may want to change his style of play, the assemblies can be removed by careful prying. Residual adhesive may be removed from the surface of the racquet by a solution of isopropyl alcohol and acetone and the weight and balance readjusted.

There is also provided in accordance with this invention a package including a plurality of weight-and-balance adjustment assemblies. The package includes a card on which are mounted adjustment assemblies of different kinds. For example, there may be a plurality of sets of assemblies for mounting inside of the frame with the weights of different sets of different thickness. There may also be similar sets for mounting on the outside of the frame and one or more assemblies (butt-cap assemblies) for mounting on the end of the handle. If there are several butt-cap assemblies, their weights may be of different thickness. Each adjustment assembly as produced includes a weight to one of whose bases the adhesive is secured. The adhesive for this assembly is stamped out of a sheet with release liners on both faces; i.e., with the adhesive sandwiched between release liners. The release liner is peeled off one face and this face is adhered to the weight. Preparatory to being mounted in the package, the assembly carries the release liner on the opposite faces. The die which stamps out the adhesive and release liners is shaped so that the surfaces of the adhesive and its release liners match the bonded surface of the weight. The card of the package has a plurality of tapes with double faced adhesive. The tape is attached to the card at one face. Each adjustment assembly is mounted on the unbonded face of a tape with the unpeeled release liner adhered to the tape. The card is encased in a bag typically of polyethylene. When an adjustment assembly is to be adhered to a racquet, it is removed from the release liner which is adhered to the tape and is ready for adhering to a racquet.

Also, within the contemplated scope of this invention, is a racquet having adjustment assemblies according to this invention integrated therewith. The assemblies are adhered to its frame, throat and/or handle. The racquet may be of conventional construction. It need not have a frame structured to carry weights as does the racquet disclosed in Latham U.S. Pat. No. 3,625,512.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings, in which:

FIG. 1 is a plan view of a weight-and-balance adjustment assembly according to this invention, to be secured to the inside or outside of the frame of a racquet;

FIG. 2 is a view in transverse section taken along Line II—II of FIG. 1;

FIG. 3 is a view in isometric showing a modification of the assembly shown in FIGS. 1 and 2;

FIG. 4 is a view in isometric showing an adjustment assembly according to this invention, to be secured to the outside of the frame of a racquet when a racquet is restrung;

FIG. 5 is a view in isometric showing a butt-cap adjustment assembly to be secured to the end of the handle of a racquet;

FIG. 7 is a fragmental view in end elevation as viewed towards the outside of the rim of a racquet showing the manner in which an adjustment assembly as shown in FIGS. 1 and 2 or FIG. 3 is secured to the outside of a racquet;

DETAILED DESCRIPTION OF EMBODIMENTS

Figure 11:
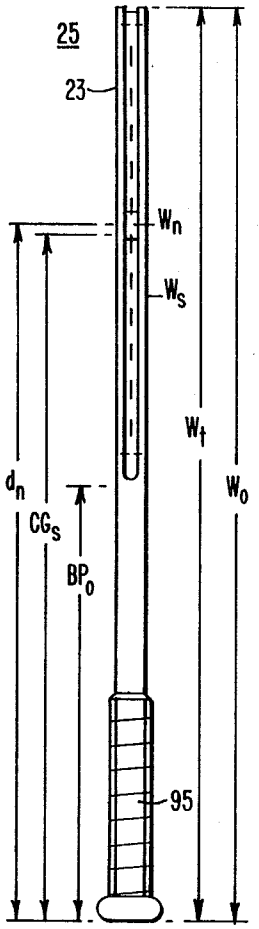
FIG. 11 is a view in side elevation taken in the direction XI—XI of FIG. 10.

With reference to FIG. 11, the balance point BP is expressed as a function of the weight and dimensions of the conventional parts of a racquet and of the weights of the weight-and-balance adjustment assemblies in the following equation:

$$BP=[W_o(BP_o)+W_s(CG_s)+W_1(d_1)+\ldots+W_n(d_n)]/W_T$$

Where

BP is the final balance point measured from butt end:

$W_o$ is the unstrung weight of the racquet, $BP_o$ is the balance point of the unstrung racquet, $W_s$ is the weight of the string, $CG_s$ is the distance from the butt to centerline of string, $W_n$ is weight of a lead weight, $d_n$ is the distance from the butt to the weight, and $W_T$ is total of all weights, string and raoquet.

This equation shows that a racquet can be balanced and weighted in any combination for player satisfaction.

The advantages of the invention are ease of application and removal, the range of possible weights and balances and the adaptation to all types, sizes and shapes of racquets, particularly conventional racquets.

FIGS. 1 and 2 show a weight-and-balance adjustment assembly 21 for the frame 23 (FIGS. 10, 11) of a racquet 25. The assembly 21 includes a weight 27, typically composed of lead. In longitudinal cross-section the weight 27 is circular with diametral notches 29. Different weights 27 of different thicknesses are available. An adhesive disc 31 is secured to one base of the weight 27. The adhesive 31 is composed of very high bonding acrylic foam and is shaped to match the shape of the weight 27 so that the adhesive is flush with the weight along the of the assembly 21. The notches enable the assembly to clear the strings 33 (FIG. 10) when the assembly is adhered to the frame 23.

Typical dimensions of the assembly 21 and its parts are as follows:

Diameter . . . $\frac{5}{8}''$ to $\frac{3}{4}''$

Spacing between apices of notches . . . $\frac{1}{4}''$ to $\frac{3}{8}''$

Thickness of weight 27 . . . 1/32" to 3/16"

Thickness of adhesive 31 . . . 0.025" to 0.045"

A weight 27 of $\frac{5}{8}''$ diameter weighs about $3\frac{1}{2}$ grams. The weight of the adhesive 31 is negligible. The assembly 21 can be molded by hand so that its bonded surface matches the curvature of the frame 23. These dimensions are for an assembly 21 predominantly used on the inside of the frame of a racquet.

The assembly 41 shown in FIG. 3 also serves to be secured to the frame 23. This assembly 41 includes a generally rectangular weight 43 to which a generally rectangular adhesive 45 is secured. Opposite sides of the assembly have notches 47 for clearing the strings 33.

Typical dimensions for the assembly 41 are as follows;

Length . . . $\frac{5}{8}''$ to $\frac{3}{4}''$

Width . . . $\frac{5}{8}''$ to $\frac{3}{4}''$ for use inside the frame and $\frac{1}{8}''$ to $\frac{3}{8}''$ for use outside the frame Distance between inner ends of notches . . . $\frac{1}{4}''$ to $\frac{3}{8}''$ Thickness of weight and adhesive same as for assembly 21.

Figure 6:
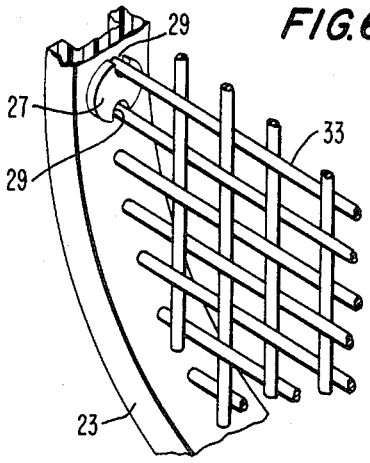
FIG. 6 is a fragmental view in isometric showing the manner in which an adjustment assembly as shown in FIGS. 1 and 2 is secured to the inside of a racquet frame.
Figure 7A:
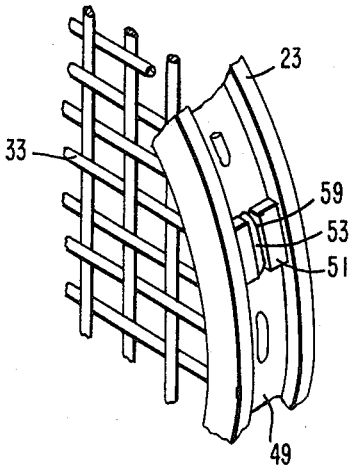
FIG. 7A is a fragmental view in isometric showing the manner in which an adjustment assembly as shown in FIG. 4 is secured to the outside of a racquet frame.
Figure 7:
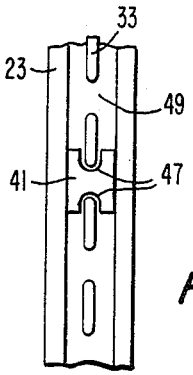

Weight-and-balance adjustment can also be achieved by securing the adjustment assembly 21 shown in FIGS. 1 and 2 or the adjustment assembly 41 shown in FIG. 3 to the outside of a frame 23. In this case the assembly must be dimensioned so that it can be inserted in the groove 49 (FIG. 7) of the frame 23 through which the string 33 extends. FIG. 7 shows a portion of a frame 23 to whose outside an assembly as shown in FIG. 3 is secured. The string 33 is cleared by the notches 47.

FIG. 4 shows a weight 51 for use on the outside of a racquet 25 in situations where the owner has determined with what weights and in what weight positions the weight-and-balance adjustment should be effected. The weight 51 is structured to be secured to the outside of the frame 23 by a loop 53 (FIG. 7A) of the string during restringing. The weight 51 includes two generally rectangular sections 55 and 57 joined by an upwardly convexed section 59 between them. The ends of section 59 are below the sections 55 and 57. As shown in FIG. 7A, the weight 51 is secured by the loop 53 of string which engages the convexed section 59. An adhesive (not shown) may be adhered to the surface of the weight 51 which engages the frame.

Typical dimensions for assembly 51 are the same as for assembly 41 for use on the outside of the frame.

FIG. 5 shows a weight-and-balance adjustment assembly 71 for the end of the handle; i.e., a butt-cap assembly. The assembly 71 includes a weight 73, typically of lead, in the form of a thin circular cylinder or disc, whose base a flush circular block 75 of adhesive is secured. The disc 73 has a diameter of about 1" and a thickness of about 1/16". The adhesive may be a thin strip having a thickness of about 0.025". The adjustment assembly 71 has a weight of about 7 grams.

Figure 9:
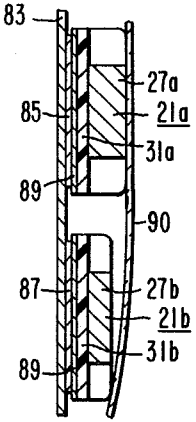
FIG. 9 is a view in section taken along Line IX—IX of FIG. 8.
Figure 8:
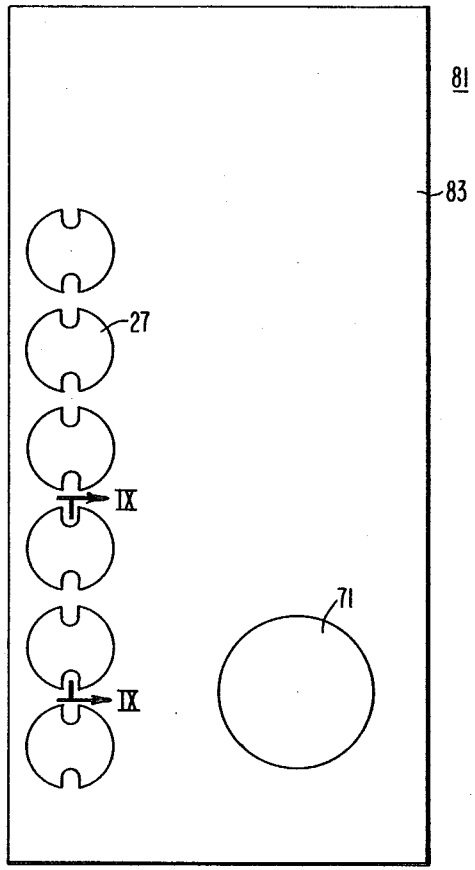
FIG. 8 is a plan view of a package of weight-and-balance adjustment assemblies.

The package 81 (FIGS. 8, 9) includes a card 83 to which a plurality of double-faced adhesive tapes 85 and 87 are adhered. Typically, a plurality of assemblies **21*a* and 21*b* as shown in FIGS. 1 and 2 are secured to the tapes 85 and 87. Each assembly 21*a* includes a weight 27*a* and an adhesive 31*a*. Each weight 21*b* includes a weight 27*b* and an adhesive 31*b* (FIG. 9). The weight 27*a* has a greater depth or heighth than the weight 27*b*. A release liner 89 is bonded to each adhesive 31*a* and 31*b*. The unbonded face of each release liner is secured to the tape 85 or tape 87. When an adjustment assembly 21*a* or 21*b* is to be used, it is peeled from the associated release liner 89 and is ready to be adhered to a racquet. The assembly 71 is mounted on a tape 87 (not shown) in the same way as the assemblies 21*a* and 21*b* are mounted on the tape 85. There may be a number of additional tapes like 85 and 87 on the card on which weight-and-balance adjustment assemblies are mounted. Overall, the weights on the assemblies may have a magnitude of between $3\frac{1}{2}$ and 13 grams. The card 83 and the assemblies mounted on it are enclosed in a bag 90, typically of transparent polyethylene. The package 81** gives the user extensive flexibility for adjusting the weight and balance of a racquet.

Figure 10:
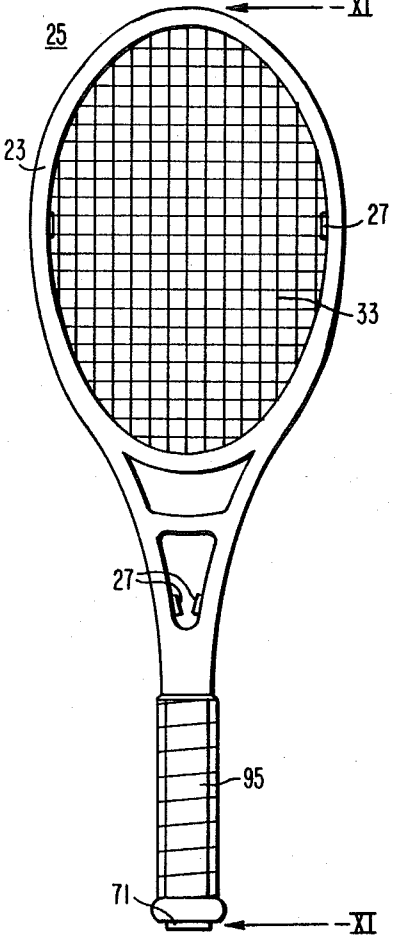
FIG. 10 is a plan view of a racquet in accordance with this invention.

The racquet 91 shown in FIGS. 10 and 11 is a conventional racquet having a frame 23, a throat 93 and a handle 95. Adjustment assemblies 21 (FIGS. 1, 2) are mounted inside on the frame and throat. A butt-cap assembly 71 (FIG. 5) is mounted in the end of the handle.

While preferred embodiments of this invention have been disclosed herein, many modifications thereof are feasible. This invention is not to be restricted except insofar as is necessitated by the spirit of the prior art

We claim:

1. For use in adjusting the weight and balance of a racquet having a frame and a butt cap, a package including a card having secured to the surface thereof a plurality of weight-and-balance adjusting assemblies, each said adjusting assembly including a weight, said weight having a high-bonding adhesive secured to one surface thereof and said weight being secured to said card such that one side of the adhesive contacts the weight while the other side of said adhesive contacts the card certain of said assemblies having contours having different configurations than others of said assemblies, each said certain and said other adjusting assemblies having a unique contour configuration and being uniquely dimensioned so that each adjusting assembly of a given contour configuration and dimension fits into and is accomodated by a selected area of the surface of said racquet which area corresponds to said accomodated assembly, assemblies of different contour configurations being accomodated by different corresponding areas of said racquet, certain of said weight-and-balance adjusting assemblies having comtour configurations shaped to be adhered to the surface area of said frame of said racquet which is bounded by adjacent string sections threaded through said frame, the said package being characterized by that each of said certain weight-and-balance adjusting assemblies has slots in its rim for clearing said adjacent string sections.

2. The combination of a racquet and a package of weight-and-balance adjusting assemblies, said racquet having a handle from which a frame extends and strings threaded through the frame penetrating through inner and outer surfaces of the frame, said package including a card having secured to the surface thereof a plurality of weight-and-balance adjusting assemblies, each said adjusting assembly including a weight having a high bonding adhesive secured, thereto and said weight being secured to said card such that one side of the adhesive contacts the weight while the other side of the adhesive contacts the card certain of said assemblies having different contour configurations and dimensions than others of said assemblies, the contour configuration of each assembly having a unique shape uniquely adapted to be accomodated by a selected area of the surface of said racquet, said racquet having at least one weight and balance adjusting assembly secured thereto at a selected area thereof, said at-least-one adjusting assembly having a contour configuration uniquely shaped and dimensioned to accomodate the shape of the selected area of said racquet to which said adjusting assembly is secured.

3. For use in adjusting the weight and balance of a racquet having a frame and a butt-cap, and having strings threaded through said frame, a package including a card having secured to the surface thereof a plurality of weight-and-balance adjusting assemblies, each said assembly including a weight, said weight having a high-bonding adhesive secured thereto and said weight being secured to said card such that one side of the adhesive contacts the weight while the other side of the adhesive contacts the card, said assemblies having different contours, each contour having a form and being dimensioned so that said eac adjusting assembly of a given contour fits into and is accomodated by a selected area of the surface of said racquet which area corresponds to said accomodated assembly, assemblies of different contours being accomodated by different corresponding areas of said racquet, certain of said weight-and-balance adjusting assemblies having contours shaped to be adhered to the surface area of said frame of said racquet which is bounded by adjacent string sections threaded through said frame, the said package being characterized by that each of said certain weight-and-balance adjusting assemblies has slots in its rim for clearing said adjacent string sections.

* * * * *